US011180862B2

(12) United States Patent
Liu

(10) Patent No.: US 11,180,862 B2
(45) Date of Patent: Nov. 23, 2021

(54) ADVANCED ALUMINUM ELECTROLYSIS CELL

(71) Applicant: ELYSIS LIMITED PARTNERSHIP, Montreal (CA)

(72) Inventor: Xinghua Liu, Murrysville, PA (US)

(73) Assignee: ELYSIS LIMITED PARTNERSHIP, Montreal (CA)

( * ) Notice: Subject to any disclaimer, the term of this patent is extended or adjusted under 35 U.S.C. 154(b) by 142 days.

(21) Appl. No.: 16/316,234

(22) PCT Filed: Jul. 7, 2017

(86) PCT No.: PCT/US2017/041188
§ 371 (c)(1),
(2) Date: Jan. 8, 2019

(87) PCT Pub. No.: WO2018/009862
PCT Pub. Date: Jan. 11, 2018

(65) Prior Publication Data

US 2019/0169761 A1 Jun. 6, 2019

Related U.S. Application Data

(60) Provisional application No. 62/359,833, filed on Jul. 8, 2016.

(51) Int. Cl.
*C25C 3/06* (2006.01)
*C25C 3/08* (2006.01)
*C25C 3/16* (2006.01)

(52) U.S. Cl.
CPC . *C25C 3/08* (2013.01); *C25C 3/16* (2013.01)

(58) Field of Classification Search
CPC .. C25C 3/08; C25C 3/06; C25C 3/125; C25C 7/025; C25C 3/16; C25C 7/005; C25C 7/02; C25C 3/00; C25C 7/00
See application file for complete search history.

(56) References Cited

U.S. PATENT DOCUMENTS 4,243,502 A 1/1981 Kugler
4,374,050 A 2/1983 Ray
(Continued)

FOREIGN PATENT DOCUMENTS

EP 1364077 B1 4/2005
GN 103484893 A 1/2014

OTHER PUBLICATIONS

Supplementary European Search Report for corresponding EP application No. 17825022 dated Nov. 8, 2019.
(Continued)

*Primary Examiner* — Zulmariam Mendez
(74) *Attorney, Agent, or Firm* — Damien Calvet; Gowling WLG (Canada) LLP

(57) ABSTRACT

In some embodiments, an electrolytic cell includes: an one anode module having a plurality of anodes; a one cathode module, opposing the anode module, and comprising a plurality of vertical cathodes, wherein each of the plurality of anodes and each of the plurality of vertical cathodes are vertically oriented and spaced one from another; a cell reservoir; and a cell bottom supporting the cathode module, wherein the cell bottom comprise an first upper surface, a second upper surface, and a channel, wherein the plurality of vertical cathodes extends upward from the upper surfaces, wherein at least one cathode block is located below the plurality of vertical cathodes, wherein the first upper surface and the second upper surface are configured to direct substantially all of the liquid aluminum produced in the electrolytic cell to the channel, and wherein the channel is configured to receive liquid aluminum from the upper surfaces.

14 Claims, 7 Drawing Sheets

(56) References Cited

U.S. PATENT DOCUMENTS

| | | | |
|---|---|---|---|
| 4,374,761 | A | 2/1983 | Ray |
| 4,399,008 | A | 8/1983 | Ray |
| 4,443,313 | A | 4/1984 | Gesing et al. |
| 4,455,211 | A | 6/1984 | Ray |
| 4,582,585 | A | 4/1986 | Ray |
| 4,584,172 | A | 4/1986 | Ray et al. |
| 4,620,905 | A | 11/1986 | Tarcy et al. |
| 5,006,209 | A | 4/1991 | Beck et al. |
| 5,279,715 | A | 1/1994 | La Camera et al. |
| 5,794,112 | A | 8/1998 | Ray et al. |
| 5,865,980 | A | 2/1999 | Ray et al. |
| 5,938,914 | A | 8/1999 | Dawless et al. |
| 6,419,812 | B1 | 7/2002 | Beck et al. |
| 6,436,273 | B1 | 8/2002 | De Nora et al. |
| 2002/0166775 | A1 | 11/2002 | De Nora |
| 2003/0141197 | A1 | 7/2003 | Barnett et al. |
| 2012/0318667 | A1 | 12/2012 | Yang et al. |

OTHER PUBLICATIONS

International Preliminary Report on Patentability for corresponding PCT/US2017/041188 dated Jan. 8, 2019.

International Search Report and Written Opinion, dated Sep. 22, 2017, from corresponding International Patent Application No. PCT/US2017/041188.

ADVANCED ALUMINUM ELECTROLYSIS CELL

CROSS-REFERENCE TO RELATED APPLICATIONS

This application is a national phase of International Patent Application No. PCT/US2017/04118, filed Jul. 7, 2017, which claims benefit of U.S. provisional application No. 62/359,833, filed Jul. 8, 2016, each of which is herein incorporated by reference in its entirety.

FIELD OF THE INVENTION

The present invention relates to apparatus and methods for producing aluminum metal and more particularly, to apparatus and methods for producing aluminum metal by the electrolysis of alumina using oxygen evolving anodes and aluminum wettable cathodes.

BACKGROUND

Hall-Héroult electrolytic cells are utilized to produce aluminum metal in commercial production of aluminum from alumina that is dissolved in molten electrolyte (a cryolite "bath") and reduced by a DC electric current using a consumable carbon anode. Traditional methods and apparatus for smelting alumina utilize carbon anodes that are consumed slowly and generate CO2, a "greenhouse gas." Traditional anode shapes and sizes also limit electrolysis of the reactant (dissolved alumina), which travels to the surface of the anode bottom for reaction. This will enhance the frequency of the phenomenon called, "anode effect" that results in the generation of CF4, another regulated "greenhouse" gas. Besides the traditional commercial aluminum smelter, the prior art also includes aluminum smelter designs where the anodes and cathodes have a vertical orientation, e.g., as described in U.S. Pat. No. 5,938,914 to Dawless, entitled, Molten Salt Bath Circulation Design For An Electrolytic Cell, which is incorporated by reference herein in its entirety. Notwithstanding, alternative electrode and aluminum smelter designs remain of interest in the field.

SUMMARY

In some embodiments, an electrolytic cell includes: at least one anode module having a plurality of anodes, wherein each of the plurality of anodes is an oxygen-evolving electrode; at least one cathode module, opposing the anode module, wherein the at least one cathode module comprises a plurality of vertical cathodes, wherein each of the plurality of anodes and each of the plurality of vertical cathodes have surfaces thereon that are vertically oriented and spaced one from another, wherein the cathodes are wettable by molten aluminum, and wherein the at least one cathode module is coupled to a bottom of the electrolytic cell; a cell reservoir; an electrolyte disposed within the cell reservoir; and a cell bottom supporting the cathode module, wherein the cell bottom comprise an first upper surface, a second upper surface, and a channel, wherein the plurality of vertical cathodes extends upward from the upper surfaces, wherein the plurality of vertical cathodes are completely submerged in the electrolyte, wherein at least one cathode block is located below the plurality of vertical cathodes, wherein the first upper surface and the second upper surface are configured to direct substantially all of the liquid aluminum produced in the electrolytic cell to the channel, and wherein the channel is configured to receive liquid aluminum from the upper surfaces.

In some embodiments, the upper surface of the cell bottom has a first upper surface and a second upper surface with the channel between the first upper surface and the second upper surface.

In some embodiments, the channel is located equidistant from a first sidewall and a second sidewall of the electrolytic cell.

In some embodiments, the electrolytic cell further comprises a trough located proximate at least one of the first sidewall or the second sidewall of the electrolytic cell.

In some embodiments, the first upper surface is sloped from a first sidewall of the electrolytic cell toward the channel.

In some embodiments, the first upper surface is sloped from a vertical cathode surface to a second upper surface, and wherein the second upper surface is sloped from a sidewall of the electrolysis cell toward the channel.

In some embodiments, the first upper surface and the second upper surface are sloped from the sidewalls of the electrolytic cell to the channel.

In some embodiments, the first upper surface comprises a first fall line extending from the surface of the vertical cathode toward the second upper surface.

In some embodiments, the first upper surface has a slope of 0 to 60 degrees along the first fall line from the surface of the vertical cathode to the second upper surface.

In some embodiments, the second upper surface comprises a second fall line extending from the sidewall toward the channel.

In some embodiments, the second upper surface has a slope of 0 to 60 degrees along the second fall line from the sidewall to the channel.

In some embodiments, the cell bottom comprises aluminum wettable material.

In some embodiments, the aluminum wettable material is at least one of TiB2, ZrB2, HfB2, SrB2, or combinations thereof.

In some embodiments, the channel has a slope of 0 to 15 degrees along a third fall line from a first endwall to a second endwall of the electrolytic cell.

In some embodiments, the channel comprises aluminum wettable material.

In some embodiments, the aluminum wettable material is at least one of TiB2, ZrB2, HfB2, SrB2, or combinations thereof.

In some embodiments, the electrolytic cell further comprises a sump proximate a low point of the channel.

In some embodiments, a method for producing aluminum metal by the electrochemical reduction of alumina, includes: supplying an electric current to a plurality of vertical anodes in an aluminum electrolysis cell, wherein the aluminum electrolysis cell comprises a bottom having an upper surface, a plurality of vertical cathodes extending upward from the upper surface and interleaved with the plurality of vertical anodes, and a channel located within the bottom of the cell, and wherein the channel is configured to collect liquid aluminum from the cell passing the electric current through a electrolyte contained in the aluminum electrolysis cell, receiving the electric current via the plurality of vertical cathodes and a bottom cathode; producing liquid aluminum at outer surfaces of the cathode, wherein the liquid aluminum flows via gravity from the outer surfaces of the cathode, across the upper surface and into the channel, thereby creating a flowing layer of liquid aluminum over the upper surface, and collecting the liquid aluminum from the channel into a sump.

In some embodiments, collecting the liquid aluminum includes removing at least some of the liquid aluminum from the sump.

In some embodiments, collecting the liquid aluminum includes removing the liquid aluminum periodically during the operation of the aluminum electrolysis cell.

In some embodiments, collecting the liquid aluminum includes removing the liquid aluminum essentially continuously during the operation of the aluminum electrolysis cell.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1A:
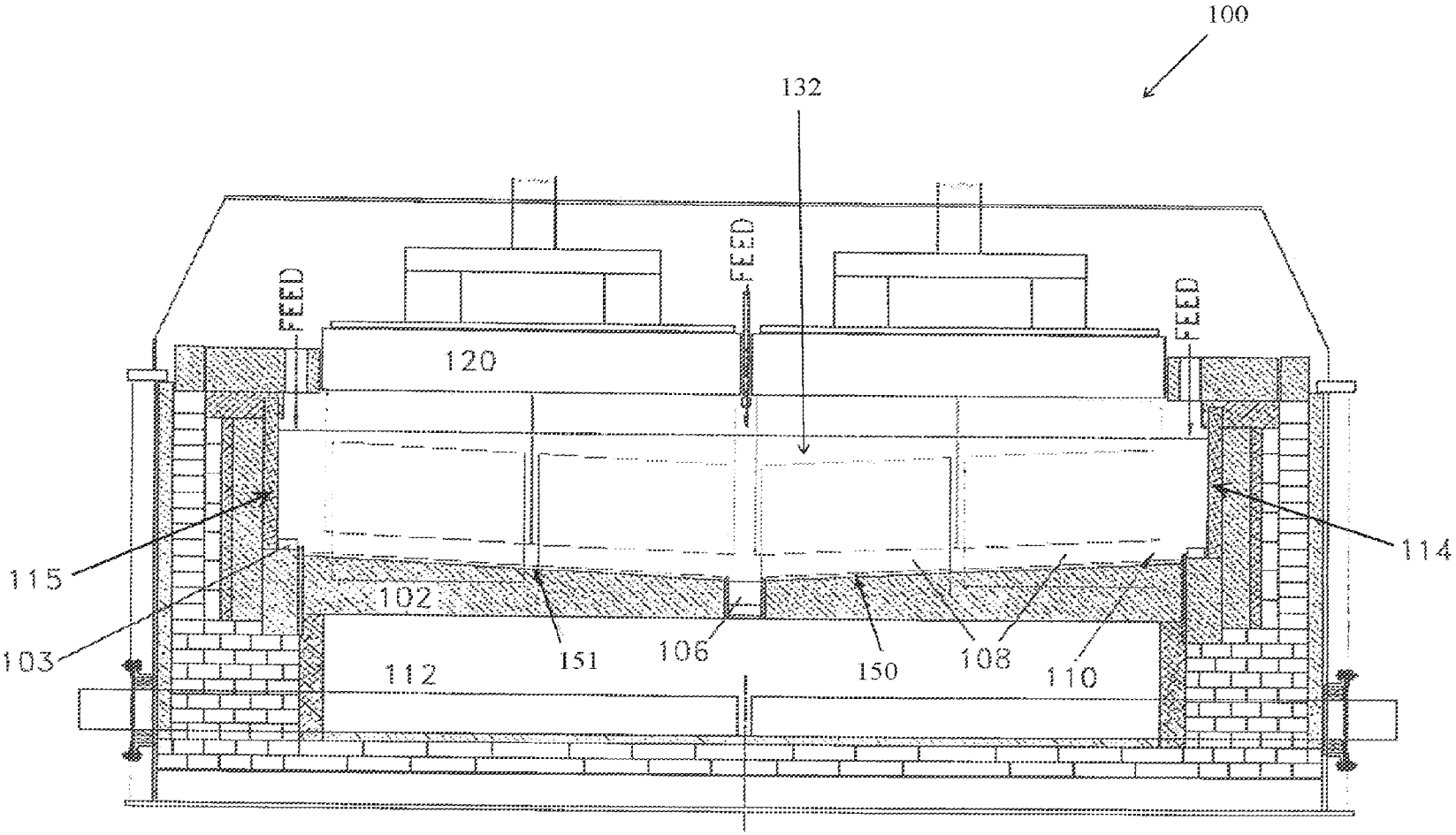
FIG. 1A is a partially schematic cross-sectional front view of an electrolytic cell in accordance with some embodiments of the present disclosure.
Figure 1B:
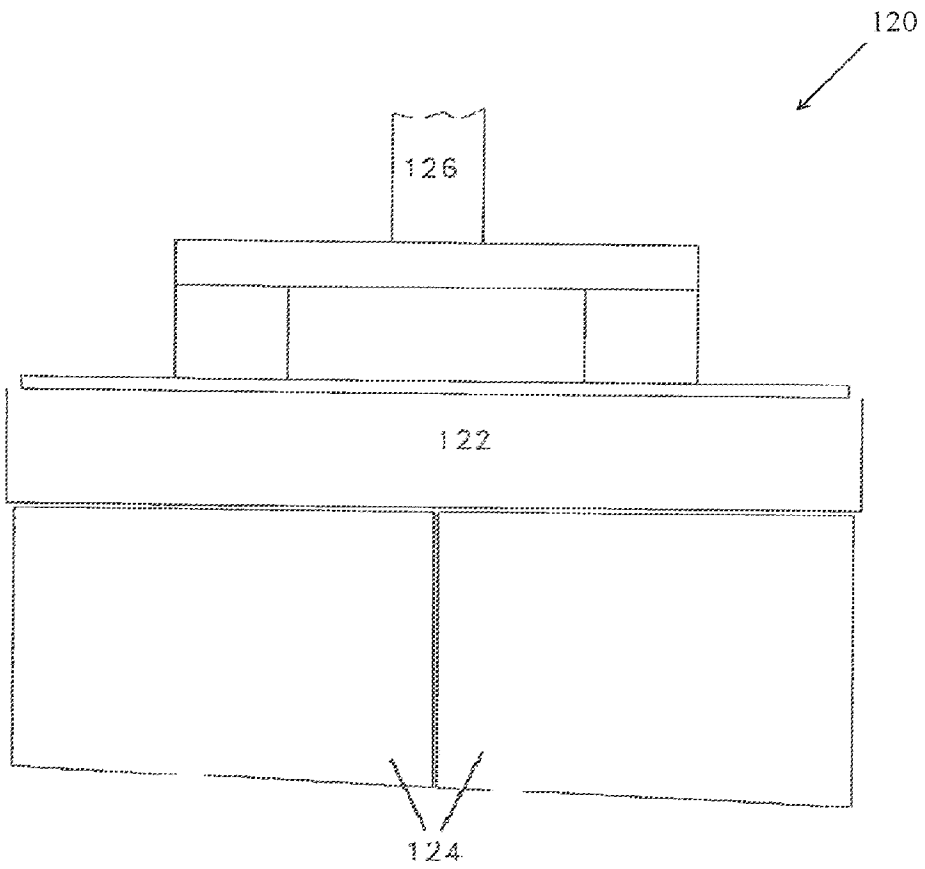
FIG. 1B is a front view of a portion of an anode module in accordance with some embodiments of the present disclosure.
Figure 1C:
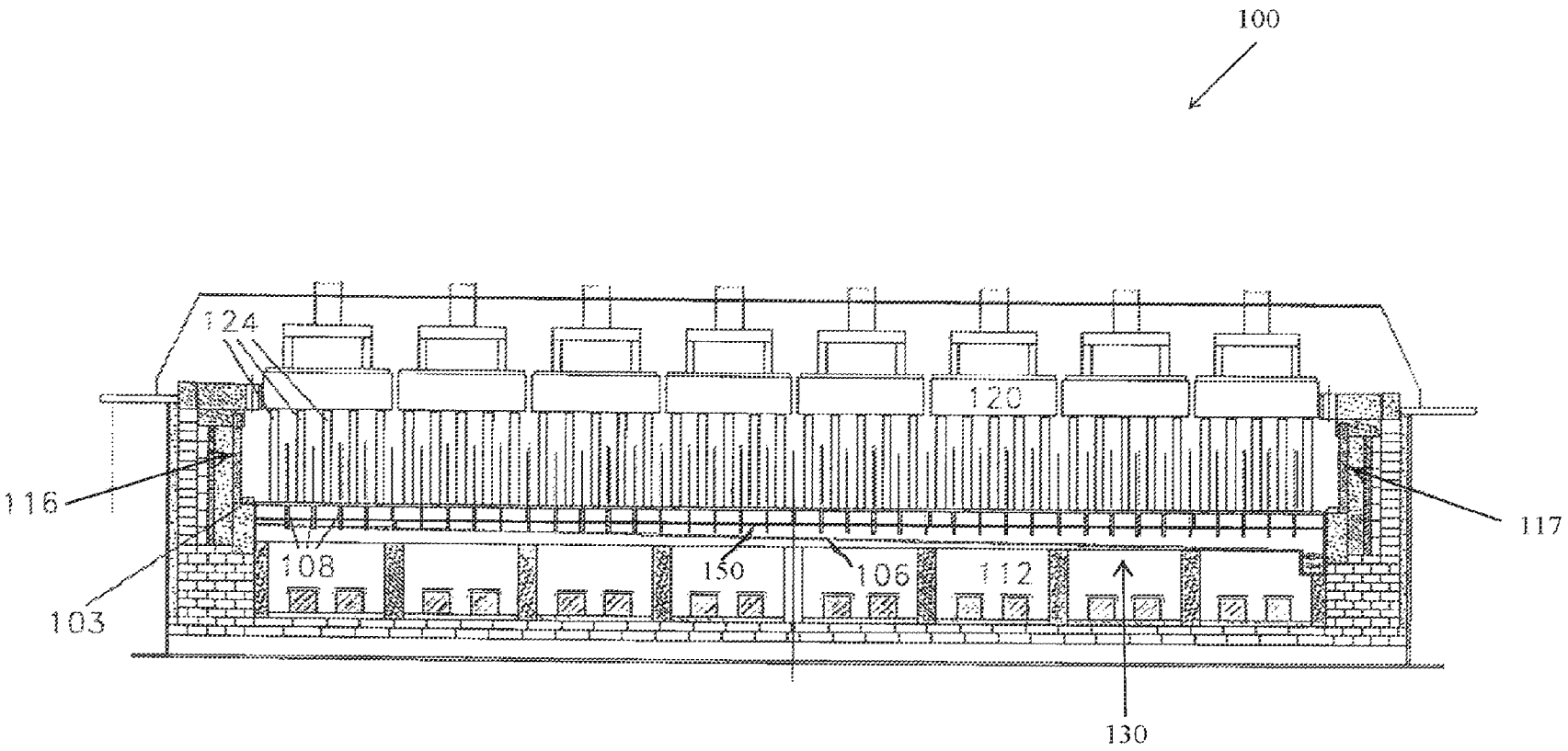
FIG. 1C is a partially schematic cross-sectional side view of an electrolytic cell in accordance with some embodiments of the present disclosure.
Figure 1D:
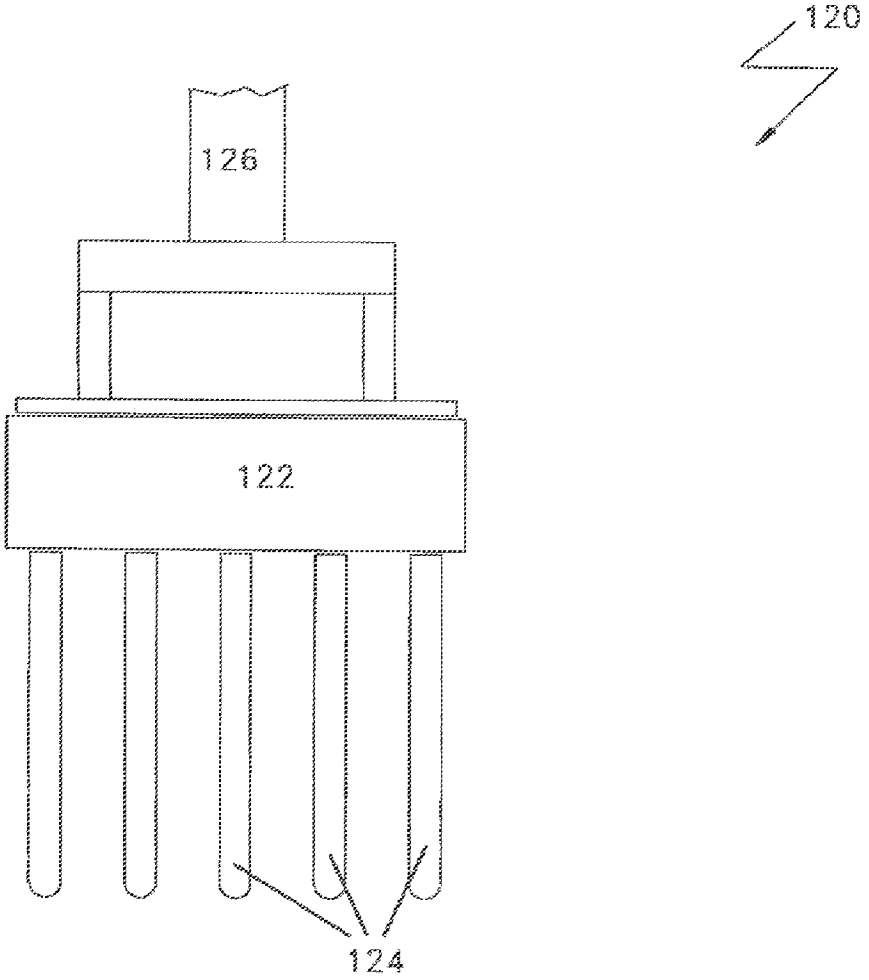
FIG. 1D is a side view of a portion of an anode module in accordance with some embodiments of the present disclosure.
Figure 1E:
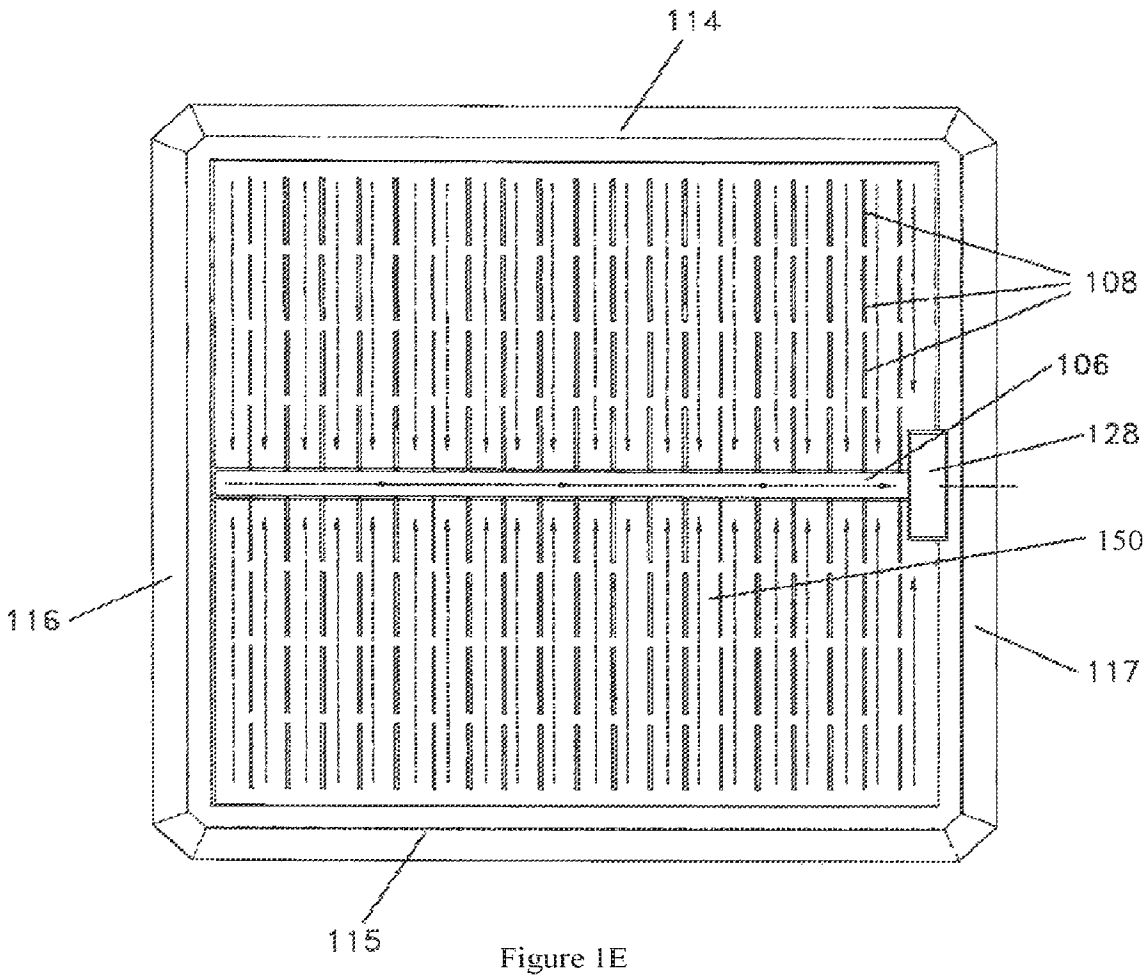
FIG. 1E is a diagrammatic plan views of an electrolytic cell in accordance with some embodiments of the present disclosure.
Figure 1F:
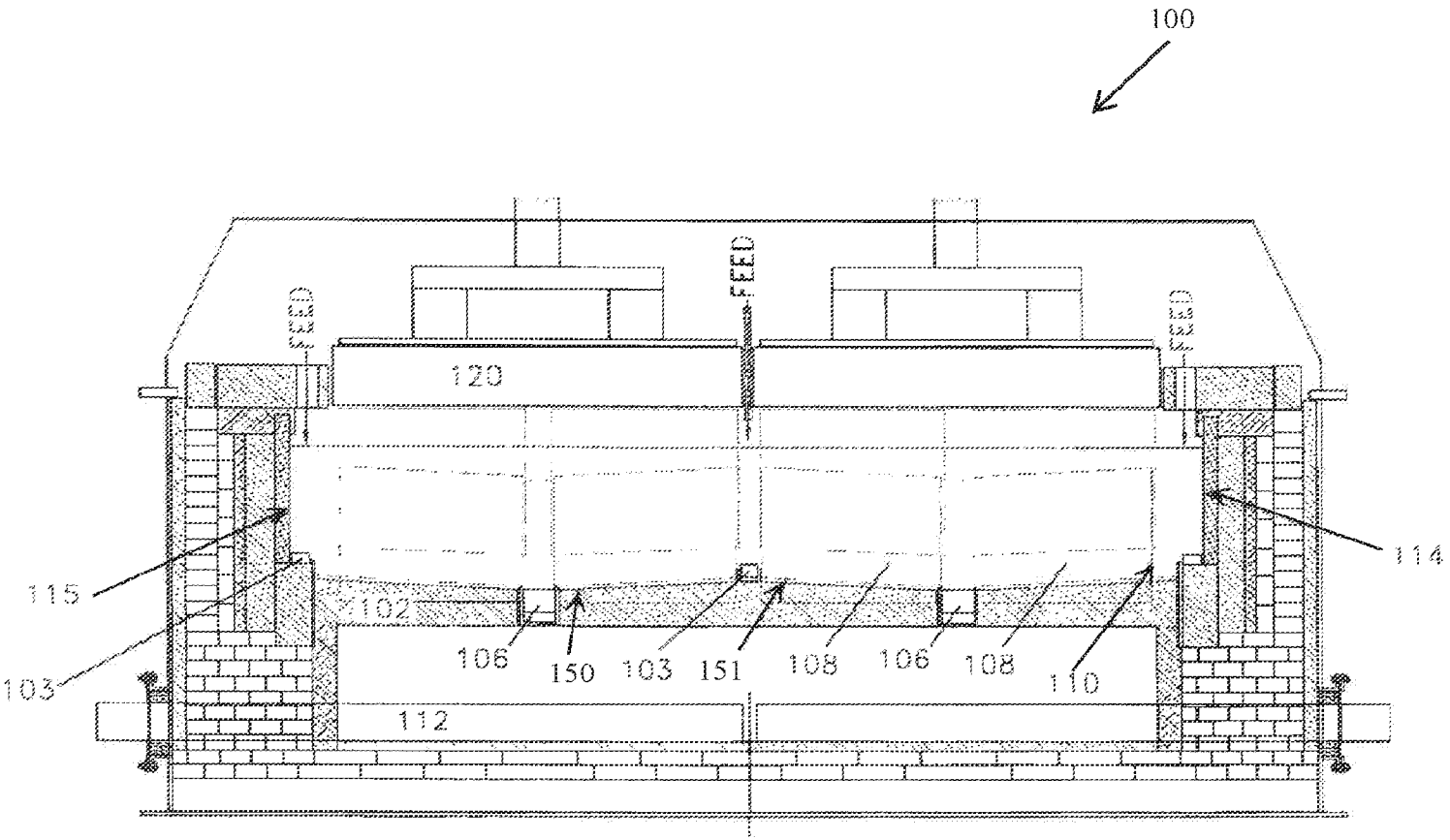
FIG. 1F is a partially schematic cross-sectional front view of an electrolytic cell in accordance with some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

As used herein, an "aluminum-wettable" means having a contact angle with liquid aluminum of not greater than 90 degrees.

As used herein, "fall line" means the line of greatest slope on a surface.

As used herein, "horizontal aspect ratio" means the longest horizontal dimension of an electrode divided by shortest horizontal dimension of an electrode.

As used herein, "long horizontal axis" means a horizontal line parallel to longest horizontal dimension of an electrode.

As used herein, a "short horizontal axis" means a line parallel to an electrode widthwise, wherein the line is in a horizontal plane.

As used herein, "liquid aluminum" means aluminum metal above its melting point.

As used herein a surface having a "slope of X degrees" means the surface forms an angle with the horizontal plane of X degrees. For example, a surface having a slope of 90 degrees is a vertical surface.

FIGS. 1A through 1E depict an aluminum electrolysis cell (100), or portions thereof, in accordance with some embodiments of the instant disclosure. In some embodiments, the aluminum electrolysis cell (100) comprises a cell bottom (102), sidewalls (114, 115), and endwalls (116, 117). In some embodiments, the cell bottom (102) of the aluminum electrolysis cell (100) has at least one upper surface that is sloped to drain into at least one channel (106). In some embodiments, the cell bottom (102) of the aluminum electrolysis cell (100) may have a plurality of upper surfaces, each upper surface sloped to drain into a channel (106). In some embodiments, the cell bottom (102) of the aluminum electrolysis cell (100) has a first upper surface (150), a second upper surface (151), and a channel (106) therebetween. In some embodiments, the aluminum electrolysis cell (100) may include two or more channels (106) formed within the bottom (102) of the cell.

In some embodiments, the first upper surface (150) is sloped from the sidewalls of the electrolytic cell to the channel (106) and from vertical cathode plates (108), coupled to the cell bottom (102) and extending vertically toward the anode (124), to a second upper surface (151).

In some embodiments, the first upper surface (150) of the cell bottom (102) may have a fall line that extends from the surface of the vertical cathode plates (108) toward the second upper surface (151).

In some embodiments, the second upper surface (151) of the cell bottom (102) may be sloped toward the channel (106). In some embodiments, the second upper surface (151) of the cell bottom (102) may be sloped from the sidewalls toward the channel (106). In some embodiments, the second upper surface (151) of the cell bottom (102) may have a fall line that extends from the sidewalls toward the channel (106). In some embodiments, at least one of the upper surfaces (150, 151) may be aluminum-wettable (i.e., comprised of at least one aluminum-wettable material). In some embodiments, the aluminum-wettable material(s) include at least one of TiB2, ZrB2, HfB2, SrB2, carbonaceous materials, and combinations thereof.

Figure 2B:
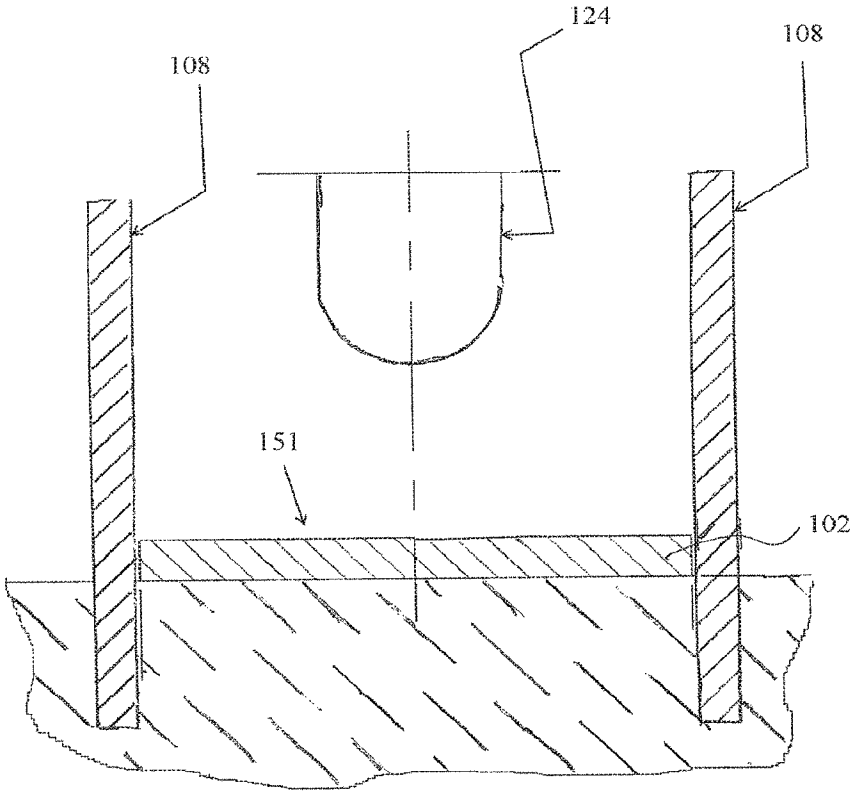
FIGS. 2A-2B are schematic cross-sectional views of an electrolytic cell in accordance with some embodiments of the present disclosure.
Figure 2A:
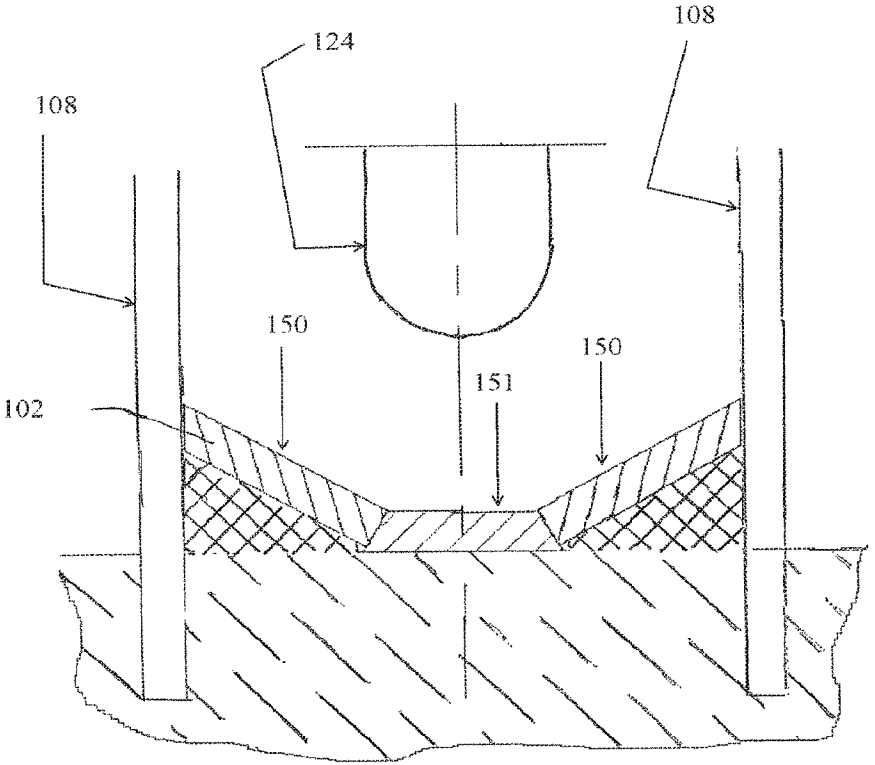

FIG. 2A and FIG. 2B are schematic cross-sectional views of an electrolytic cell in accordance with some embodiments of the present disclosure. In some embodiments, as shown in FIG. 2A, a first upper surface (150) is sloped from vertical cathode plates 108 that are coupled to the cell bottom (102). Aluminum metal produced by the electrochemical reduction of alumina within the cell drains along the vertical cathode (108) toward the cell bottom (102). In FIG. 2A, the sloped first upper surface (150) drains the aluminum metal to the second sloped upper surface (151). The aluminum metal flows through the second sloped upper surface (151) into the channel (106). In some embodiments, as shown in FIG. 2B, the aluminum metal drains along the vertical cathode (108) toward the cell bottom (102), where the aluminum metal flows through the second sloped upper surface (151) into the channel (106).

In some embodiments, the channel (106) may be located approximately equidistant from opposite sidewalls (114, 115) of the aluminum electrolysis cell (100). In some embodiments, the channel (106) is configured to collect liquid aluminum produced in the aluminum electrolysis cell (100). In some embodiments, the channel (106) may comprise aluminum-wettable materials. In some embodiments, the aluminum-wettable material(s) include at least one of TiB2, ZrB2, HfB2, SrB2, carbonaceous materials, and combinations thereof. In one embodiment, the channel (106) is sloped from a high point to a low point. In one embodiment, the aluminum electrolysis cell includes a sump (128) located proximal the low point of the channel (106). In one embodiment, the horizontal component of the fall line of the upper surface forms an angle of 60 to 120 degrees with a horizontal component of the fall line of the channel.

In some embodiments, the aluminum electrolysis cell (100) may include a trough (103) proximal the first sidewall (114). In some embodiments, the trough (103) may be configured to collect sludge (e.g., undissolved alumina) from the aluminum electrolysis cell (100). In some embodiments, the aluminum electrolysis cell (100) may include a trough (103) proximal the second sidewall (115). In some embodiments, the aluminum electrolysis cell (100) may include a trough (103) proximal the first endwall (116). In some embodiments, the aluminum electrolysis cell (100) may include a trough (103) proximal the second endwall (117).

In some embodiments, the first upper surface (150) of the cell bottom (102) has a slope of 0 to 60 degrees along the fall line from the first sidewall to the second upper surface. In some embodiments, the first upper surface (150) of the cell bottom (102) has a slope of 0 to 45 degrees along the fall line from the first sidewall to the second upper surface. In some embodiments, the first upper surface (150) of the cell bottom (102) has a slope of 0 to 40 degrees along the fall line from the first sidewall to the second upper surface. In some embodiments, the first upper surface (150) of the cell bottom (102) has a slope of 0 to 35 degrees along the fall line from the first sidewall to the second upper surface. In some embodiments, the first upper surface (150) of the cell bottom (102) has a slope of 0 to 30 degrees along the fall line from the first sidewall to the second upper surface. In some embodiments, the first upper surface (150) of the cell bottom (102) has a slope of 0 to 25 degrees along the fall line from the first sidewall to the second upper surface. In some embodiments, the first upper surface (150) of the cell bottom (102) has a slope of 0 to 20 degrees along the fall line from the first sidewall to the second upper surface. In some embodiments, the first upper surface (150) of the cell bottom (102) has a slope of 0 to 15 degrees along the fall line from the first sidewall to the second upper surface. In some embodiments, the first upper surface (150) of the cell bottom (102) has a slope of 0 to 10 degrees along the fall line from the first sidewall to the second upper surface. In some embodiments, the first upper surface (150) of the cell bottom (102) has a slope of 0 to 9 degrees along the fall line from the first sidewall to the second upper surface. In some embodiments, the first upper surface (150) of the cell bottom (102) has a slope of 0 to 8 degrees along the fall line from the first sidewall to the second upper surface. In some embodiments, the first upper surface (150) of the cell bottom (102) has a slope of 0 to 7 degrees along the fall line from the first sidewall to the second upper surface. In some embodiments, the first upper surface (150) of the cell bottom (102) has a slope of 0 to 6 degrees along the fall line from the first sidewall to the second upper surface. In some embodiments, the first upper surface (150) of the cell bottom (102) has a slope of 0 to 5 degrees along the fall line from the first sidewall to the second upper surface. In some embodiments, the first upper surface (150) of the cell bottom (102) has a slope of 0 to 4 degrees along the fall line from the first sidewall to the second upper surface. In some embodiments, the first upper surface (150) of the cell bottom (102) has a slope of 0 to 3 degrees along the fall line from the first sidewall to the second upper surface. In some embodiments, the first upper surface (150) of the cell bottom (102) has a slope of 0 to 2 degrees along the fall line from the first sidewall to the second upper surface. In some embodiments, the first upper surface (150) of the cell bottom (102) has a slope of 0 to 1 degrees along the fall line from the first sidewall to the second upper surface.

In some embodiments, the first upper surface (150) of the cell bottom (102) has a slope of 0.5 to 50 degrees along the fall line from the first sidewall to the second upper surface. In some embodiments, the first upper surface (150) of the cell bottom (102) has a slope of 0.5 to 40 degrees along the fall line from the first sidewall to the second upper surface. In some embodiments, the first upper surface (150) of the cell bottom (102) has a slope of 0.5 to 30 degrees along the fall line from the first sidewall to the second upper surface. In some embodiments, the first upper surface (150) of the cell bottom (102) has a slope of 0.5 to 20 degrees along the fall line from the first sidewall to the second upper surface. In some embodiments, the first upper surface (150) of the cell bottom (102) has a slope of 0.5 to 15 degrees along the fall line from the first sidewall to the second upper surface. In some embodiments, the first upper surface (150) of the cell bottom (102) has a slope of 0.5 to 10 degrees along the fall line from the first sidewall to the second upper surface. In some embodiments, the first upper surface (150) of the cell bottom (102) has a slope of 0.5 to 8 degrees along the fall line from the first sidewall to the second upper surface. In some embodiments, the first upper surface (150) of the cell bottom (102) has a slope of 0.5 to 6 degrees along the fall line from the first sidewall to the second upper surface. In some embodiments, the first upper surface (150) of the cell bottom (102) has a slope of 0.5 to 5 degrees along the fall line from the first sidewall to the second upper surface. In some embodiments, the first upper surface (150) of the cell bottom (102) has a slope of 0.5 to 4 degrees along the fall line from the first sidewall to the second upper surface. In some embodiments, the first upper surface (150) of the cell bottom (102) has a slope of 0.5 to 3 degrees along the fall line from the first sidewall to the second upper surface. In some embodiments, the first upper surface (150) of the cell bottom (102) has a slope of 0.5 to 2 degrees along the fall line from the first sidewall to the second upper surface.

In some embodiments, the first upper surface (150) of the cell bottom (102) has a slope of 1 to 10 degrees along the fall line from the first sidewall to the second upper surface. In some embodiments, the first upper surface (150) of the cell bottom (102) has a slope of 1.5 to 8 degrees along the fall line from the first sidewall to the second upper surface. In some embodiments, the first upper surface (150) of the cell bottom (102) has a slope of 2 to 6 degrees along the fall line from the first sidewall to the second upper surface. In some embodiments, the first upper surface (150) of the cell bottom (102) has a slope of 3 to 5 degrees along the fall line from the first sidewall to the second upper surface.

In some embodiments, the second upper surface (151) of the cell bottom (102) has a slope of 0 to 60 degrees along the fall line from the second sidewall to the channel (106). In some embodiments, the second upper surface (151) of the cell bottom (102) has a slope of 0 to 45 degrees along the fall line from the second sidewall to the channel (106). In some embodiments, the second upper surface (151) of the cell bottom (102) has a slope of 0 to 40 degrees along the fall line from the second sidewall to the channel (106). In some embodiments, the second upper surface (151) of the cell bottom (102) has a slope of 0 to 35 degrees along the fall line from the second sidewall to the channel (106). In some embodiments, the second upper surface (151) of the cell bottom (102) has a slope of 0 to 30 degrees along the fall line from the second sidewall to the channel (106). In some embodiments, the second upper surface (151) of the cell bottom (102) has a slope of 0 to 25 degrees along the fall line from the second sidewall to the channel (106). In some embodiments, the second upper surface (151) of the cell bottom (102) has a slope of 0 to 20 degrees along the fall line from the second sidewall to the channel (106). In some embodiments, the second upper surface (151) of the cell bottom (102) has a slope of 0 to 15 degrees along the fall line from the second sidewall to the channel (106). In some embodiments, the second upper surface (151) of the cell bottom (102) has a slope of 0 to 10 degrees along the fall line from the second sidewall to the channel (106). In some embodiments, the second upper surface (151) of the cell bottom (102) has a slope of 0 to 9 degrees along the fall line from the second sidewall to the channel (106). In some embodiments, the second upper surface (151) of the cell bottom (102) has a slope of 0 to 8 degrees along the fall line from the second sidewall to the channel (106). In some embodiments, the second upper surface (151) of the cell bottom (102) has a slope of 0 to 7 degrees along the fall line from the second sidewall to the channel (106). In some embodiments, the second upper surface (151) of the cell bottom (102) has a slope of 0 to 6 degrees along the fall line from the second sidewall to the channel (106). In some embodiments, the second upper surface (151) of the cell bottom (102) has a slope of 0 to 5 degrees along the fall line from the second sidewall to the channel (106). In some embodiments, the second upper surface (151) of the cell bottom (102) has a slope of 0 to 4 degrees along the fall line from the second sidewall to the channel (106). In some embodiments, the second upper surface (151) of the cell bottom (102) has a slope of 0 to 3 degrees along the fall line from the second sidewall to the channel (106). In some embodiments, the second upper surface (151) of the cell bottom (102) has a slope of 0 to 2 degrees along the fall line from the second sidewall to the channel (106). In some embodiments, the second upper surface (151) of the cell bottom (102) has a slope of 0 to 1 degrees along the fall line from the second sidewall to the channel (106).

In some embodiments, the second upper surface (151) of the cell bottom (102) has a slope of 0.5 to 50 degrees along the fall line from the second sidewall to the channel (106). In some embodiments, the second upper surface (151) of the cell bottom (102) has a slope of 0.5 to 40 degrees along the fall line from the second sidewall to the channel (106). In some embodiments, the second upper surface (151) of the cell bottom (102) has a slope of 0.5 to 30 degrees along the fall line from the second sidewall to the channel (106). In some embodiments, the second upper surface (151) of the cell bottom (102) has a slope of 0.5 to 20 degrees along the fall line from the second sidewall to the channel (106). In some embodiments, the second upper surface (151) of the cell bottom (102) has a slope of 0.5 to 15 degrees along the fall line from the second sidewall to the channel (106). In some embodiments, the second upper surface (151) of the cell bottom (102) has a slope of 0.5 to 10 degrees along the fall line from the second sidewall to the channel (106). In some embodiments, the second upper surface (151) of the cell bottom (102) has a slope of 0.5 to 8 degrees along the fall line from the second sidewall to the channel (106). In some embodiments, the second upper surface (151) of the cell bottom (102) has a slope of 0.5 to 6 degrees along the fall line from the second sidewall to the channel (106). In some embodiments, the second upper surface (151) of the cell bottom (102) has a slope of 0.5 to 5 degrees along the fall line from the second sidewall to the channel (106). In some embodiments, the second upper surface (151) of the cell bottom (102) has a slope of 0.5 to 4 degrees along the fall line from the second sidewall to the channel (106). In some embodiments, the second upper surface (151) of the cell bottom (102) has a slope of 0.5 to 3 degrees along the fall line from the second sidewall to the channel (106). In some embodiments, the second upper surface (151) of the cell bottom (102) has a slope of 0.5 to 2 degrees along the fall line from the second sidewall to the channel (106).

In some embodiments, the second upper surface (151) of the cell bottom (102) has a slope of 1 to 10 degrees along the fall line from the second sidewall to the channel (106). In some embodiments, the second upper surface (151) of the cell bottom (102) has a slope of 1.5 to 8 degrees along the fall line from the second sidewall to the channel (106). In some embodiments, the second upper surface (151) of the cell bottom (102) has a slope of 2 to 6 degrees along the fall line from the second sidewall to the channel (106). In some embodiments, the second upper surface (151) of the cell bottom (102) has a slope of 3 to 5 degrees along the fall line from the second sidewall to the channel (106).

In some embodiments, the channel (106) has a slope of 0 to 15 degrees along the fall line from the first endwall to the second endwall. In some embodiments, the channel (106) has a slope of 0 to 12 degrees along the fall line from the first endwall to the second endwall. In some embodiments, the channel (106) has a slope of 0 to 10 degrees along the fall line from the first endwall to the second endwall. In some embodiments, the channel (106) has a slope of 0 to 8 degrees along the fall line from the first endwall to the second endwall. In some embodiments, the channel (106) has a slope of 0 to 6 degrees along the fall line from the first endwall to the second endwall. In some embodiments, the channel (106) has a slope of 0 to 5 degrees along the fall line from the first endwall to the second endwall. In some embodiments, the channel (106) has a slope of 0 to 4 degrees along the fall line from the first endwall to the second endwall. In some embodiments, the channel (106) has a slope of 0 to 3 degrees along the fall line from the first endwall to the second endwall. In some embodiments, the channel (106) has a slope of 0 to 2 degrees along the fall line from the first endwall to the second endwall.

In some embodiments, the channel (106) has a slope of 0.5 to 9 degrees along the fall line from the first endwall to the second endwall. In some embodiments, the channel (106) has a slope of 0.5 to 8 degrees along the fall line from the first endwall to the second endwall. In some embodiments, the channel (106) has a slope of 0.5 to 7 degrees along the fall line from the first endwall to the second endwall. In some embodiments, the channel (106) has a slope of 0.5 to 6 degrees along the fall line from the first endwall to the second endwall. In some embodiments, the channel (106) has a slope of 0.5 to 5 degrees along the fall line from the first endwall to the second endwall. In some embodiments, the channel (106) has a slope of 0.5 to 4 degrees along the fall line from the first endwall to the second endwall. In some embodiments, the channel (106) has a slope of 0.5 to 3 degrees along the fall line from the first endwall to the second endwall. In some embodiments, the channel (106) has a slope of 0.5 to 2 degrees along the fall line from the first endwall to the second endwall. In some embodiments, the channel (106) has a slope of 0.5 to 1 degrees along the fall line from the first endwall to the second endwall.

In some embodiments, the channel (106) has a slope of 1 to 5 degrees along the fall line from the first endwall to the second endwall. In some embodiments, the channel (106) has a slope of 1 to 4 degrees along the fall line from the first endwall to the second endwall. In some embodiments, the channel (106) has a slope of 1 to 3 degrees along the fall line from the first endwall to the second endwall.

In some embodiments, the channel (106) has a slope of 2 to 5 degrees along the fall line from the first endwall to the second endwall. In some embodiments, the channel (106) has a slope of 2 to 4 degrees along the fall line from the first endwall to the second endwall. In some embodiments, the channel (106) has a slope of 2 to 3 degrees along the fall line from the first endwall to the second endwall.

In some embodiments, the aluminum electrolysis cell (100) further comprises at least one anode module (120) and at least one cathode module (130). In some embodiments, the cathode module (130) comprises a plurality of vertical cathodes (108). In some embodiments, the plurality of vertical cathodes (108) are completely submerged in the electrolyte. In some embodiments, the plurality of vertical cathodes (108) extends upward from the cell bottom (102). In some embodiments, each of the plurality of vertical cathodes have a cathode outer surface (110). In some embodiments, each cathode outer surface may be aluminum-wettable (i.e., comprised of aluminum-wettable materials). In some embodiments, the vertical cathodes may have a generally rectangular shape such that each cathode has a second long horizontal axis and a second short horizontal axis. For example, in some embodiments, the vertical cathodes may have a horizontal aspect ratio of 10:1 to 100:1 (width:length). In some embodiments, the vertical cathodes (108) may be oriented such the long horizontal axis is approximately parallel to the fall line of the upper surface from which it extends.

As mentioned above, in some embodiments, the vertical cathodes may have a horizontal aspect ratio of 10:1 to 100:1 (width:length). In some embodiments, the vertical cathodes may have a horizontal aspect ratio of 10:1 to 90:1 (width:length). In some embodiments, the vertical cathodes may have a horizontal aspect ratio of 10:1 to 80:1 (width:length). In some embodiments, the vertical cathodes may have a horizontal aspect ratio of 10:1 to 70:1 (width:length). In some embodiments, the vertical cathodes may have a horizontal aspect ratio of 10:1 to 60:1 (width:length). In some embodiments, the vertical cathodes may have a horizontal aspect ratio of 10:1 to 50:1 (width:length). In some embodiments, the vertical cathodes may have a horizontal aspect ratio of 10:1 to 40:1 (width:length). In some embodiments, the vertical cathodes may have a horizontal aspect ratio of 10:1 to 30:1 (width:length). In some embodiments, the vertical cathodes may have a horizontal aspect ratio of 10:1 to 20:1 (width:length).

In some embodiments, the vertical cathodes may have a horizontal aspect ratio of 20:1 to 100:1 (width:length). In some embodiments, the vertical cathodes may have a horizontal aspect ratio of 30:1 to 100:1 (width:length). In some embodiments, the vertical cathodes may have a horizontal aspect ratio of 40:1 to 100:1 (width:length). In some embodiments, the vertical cathodes may have a horizontal aspect ratio of 50:1 to 100:1 (width:length). In some embodiments, the vertical cathodes may have a horizontal aspect ratio of 60:1 to 100:1 (width:length). In some embodiments, the vertical cathodes may have a horizontal aspect ratio of 70:1 to 100:1 (width:length). In some embodiments, the vertical cathodes may have a horizontal aspect ratio of 80:1 to 100:1 (width:length). In some embodiments, the vertical cathodes may have a horizontal aspect ratio of 90:1 to 100:1 (width:length).

In some embodiments, the aluminum electrolysis cell (100) may comprise at least one cathode block (112) located below the upper surface. In some embodiments, the cathode block (112) may be in electrical communication with the plurality of vertical cathodes (108). In some embodiments, the cathode block (112) may be integral with the bottom (102) of the aluminum electrolysis cell (100). In some embodiments, the cathode block (112) may be formed as a separate component from the bottom (102) of the aluminum electrolysis cell (100). In some embodiments, during operation of the aluminum electrolysis cell (100), current may flow from the plurality of vertical cathodes (108) into the cathode block (112) and out of the aluminum electrolysis cell (100).

In some embodiments, the aluminum electrolysis cell (100) may comprise at least one anode module (120). In some embodiments, the anode module (120) includes an anode support (122), a plurality of vertical anodes (124) and an anode rod (126). In some embodiments, the anode is an inert anode. Some non-limiting examples of inert anode compositions include: ceramic, metallic, cermet, and/or combinations thereof. Some non-limiting examples a inert anode compositions are provided in U.S. Pat. Nos. 4,374,050, 4,374,761, 4,399,008, 4,455,211, 4,582,585, 4,584,172, 4,620,905, 5,279,715, 5,794,112 and 5,865,980, assigned to the assignee of the present application. In some embodiments, the anode is an oxygen-evolving electrode. An oxygen-evolving electrode is an electrode that produces oxygen during electrolysis. In some embodiments, the cathode is a wettable cathode. In some embodiments, aluminum wettable materials are materials having a contact angle with molten aluminum of not greater than 90 degrees in the molten electrolyte. Some non-limiting examples of wettable materials may comprise one or more a $TiB_2$, $ZrB_2$, $SrB_2$, carbonaceous materials, and combinations thereof.

In some embodiments, the plurality of vertical anodes (124) extends downward from the anode support (122) such that the vertical anodes (124) are interleaved with the vertical cathodes (108). In some embodiments, the plurality of vertical anodes (124) may comprise TiB2, ZrB2, HfB2, SrB2, carbonaceous materials, and combinations thereof. In some embodiments, the anode rod is in electrical communication with the plurality of vertical anodes. In some embodiments, the anode rod (126) is configured to connect to an external power source to supply current to the electrolysis cell. In some embodiments, the anode module (120) may be adjusted vertically up or down. In this regard, in some embodiments, the overlap of the vertical anodes (124) with the vertical cathodes (108) may be adjusted by moving the anode module (120) up or down.

In some embodiments, the anode module (120) is suspended above the cathode module (130). In some embodiments, the cathode module (130) is fixedly coupled to the bottom of the aluminum electrolysis cell (100). In some embodiments, the vertical cathodes (108) are supported in a cathode support, which rests in a cell reservoir (132). The cell reservoir (132) is capable of retaining a bath of molten electrolyte. In some embodiments, the anode module (120) can be raised and lowered in height relative to the position of the cathode module (130).

The opposed, vertically oriented electrodes 108, 124 permit the gaseous phases ($O_2$), generated proximal thereto to detach therefrom and physically disassociate from the anode 124 due to the buoyancy of the $O_2$ gas bubbles in the molten salt electrolyte. Since the bubbles are free to escape from the surfaces of the anode 124 they do not build up on the anode surfaces to form an electrically insulative/resistive layer allowing the build-up of electrical potential, resulting in high resistance and, high energy consumption. The anodes 124 may be arranged in rows or columns with or without a side-to side clearance or gap between them to create a channel that enhances molten electrolyte movement, thereby improving mass transport and allowing dissolved alumina to reach the surfaces of the anode module 120.

In some embodiments, a method of using the present invention includes supplying an electric current to the plurality of vertical anodes and passing the electric current through a electrolyte contained in the aluminum electrolysis cell, wherein the solution comprises $Al_2O_3$ dissolved in at least one electrolyte. In some embodiments, the method includes receiving the electric current via the plurality of vertical cathodes and a bottom cathode, and producing, due to the passing step, liquid aluminum from the $Al_2O_3$ at the cathode outer surfaces. In some embodiments, the liquid aluminum produced at the cathode outer surfaces has a density that is higher than the density of the electrolyte. Thus, in some embodiments, the liquid aluminum flows, via gravity, from the cathode outer surfaces across the upper surface of the cell bottom and into the channel, thereby creating a flowing layer of liquid aluminum over the upper surface.

As described above, in some embodiments, the channel may be sloped into a sump (128). Thus, in some embodiments, the method may include collecting the liquid aluminum in the sump (128). In some embodiments, the method may also include removing at least some of the liquid aluminum from the sump (128). In some embodiments, the removing step may occur periodically during the operation of the aluminum electrolysis cell. In some embodiments, the removing step may occur on an essentially continuous basis during the operation of the aluminum electrolysis cell.

As described above, in some embodiments, the anode module (120) may be adjusted vertically up or down, thereby controlling the overlap of the vertical anodes (124) with the vertical cathodes (108). In some embodiments the electrical resistance between the vertical anodes (124) and the vertical cathodes (108) may depend, at least in part, on the overlap. In some embodiments, flow of current between the vertical anodes (124) and the vertical cathodes (108) may produce heat within the cell. In some embodiment, the amount of heat produced may depend, at least in part, on the electrical resistance between the vertical anodes (124) and the vertical cathodes (108). Thus, by vertically adjusting the anode module (120) up and/or down with respect to the vertical cathodes (108), the temperature of the solution contained in the aluminum electrolysis cell may be controlled.

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

I claim:

1. An electrolytic cell, comprising:

a cell reservoir configured to retain a bath of molten electrolyte disposed within the cell reservoir;

at least one anode module having a plurality of vertical anodes extending downward from an anode support and configured to be moved up and down into the cell reservoir, wherein each of the plurality of anodes is an oxygen-evolving electrode;

at least one cathode module located into the cell reservoir, opposing the at least one anode module, wherein the at least one cathode module comprises a plurality of vertical cathodes configured to interleave with the plurality of vertical anodes when the at least one anode module is located into the cell reservoir;

wherein each of the plurality of vertical anodes and each of the plurality of vertical cathodes have surfaces thereon that are vertically oriented and spaced one from another, wherein the plurality of vertical cathodes are wettable by molten aluminum; and a cell bottom of the cell reservoir for supporting the at least one cathode module, wherein each of the plurality of vertical cathodes of the at least one cathode module is coupled to the cell bottom, wherein the cell bottom comprises aluminum wettable material, wherein the cell bottom comprise a first upper surface, a second upper surface, and a channel, wherein the plurality of vertical cathodes extends upward from the first and second upper surfaces, wherein the plurality of vertical cathodes are configured to be completely submerged into the bath of molten electrolyte, wherein at least one cathode block is located below the plurality of vertical cathodes, wherein the first upper surface and the second upper surface of the cell bottom are configured to direct via gravity substantially all of the liquid aluminum produced in the electrolytic cell to the channel, and wherein the channel comprises aluminum wettable material and is configured to receive liquid aluminum from the first and second upper surfaces.

2. The electrolytic cell of claim 1, wherein the channel is located between the first upper surface and the second upper surface.

3. The electrolytic cell of claim 2, wherein the channel is located equidistant from a first sidewall and a second sidewall of the electrolytic cell.

4. The electrolytic cell of claim 3, further comprising a trough located proximate at least one of the first sidewall or the second sidewall of the electrolytic cell.

5. The electrolytic cell of claim 1, wherein the first upper surface is sloped from a vertical cathode surface to the second upper surface, and wherein the second upper surface is sloped from a sidewall of the electrolysis cell toward the channel.

6. The electrolytic cell of claim 5, wherein the first upper surface and the second upper surface are sloped from the sidewalls of the electrolytic cell to the channel.

7. The electrolytic cell of claim 5, wherein the first upper surface comprises a first fall line extending from the surface of the vertical cathode toward the second upper surface.

8. The electrolytic cell of claim 7, wherein the first upper surface has a slope of 0 to 60 degrees along the first fall line from the surface of the vertical cathode to the second upper surface.

9. The electrolytic cell of claim 8, wherein the second upper surface comprises a second fall line extending from the sidewall toward the channel.

10. The electrolytic cell of claim 9, wherein the second upper surface has a slope of 0 to 60 degrees along the second fall line from the sidewall to the channel.

11. The electrolytic cell of claim 1, wherein the aluminum wettable material of the cell bottom is at least one of $TiB_2$, $ZrB_2$, $HfB_2$, $SrB_2$, or combinations thereof.

12. The electrolytic cell of claim 1, wherein the channel has a slope of 0 to 15 degrees along a third fall line from a first endwall to a second endwall of the electrolytic cell.

13. The electrolytic cell of claim 1, wherein the aluminum wettable material of the channel is at least one of $TiB_2$, $ZrB_2$, $HfB_2$, $SrB_2$, or combinations thereof.

14. The electrolytic cell of claim 1, further comprising a sump proximate a low point of the channel.

* * * * *